US006801176B1

(12) United States Patent
Akimoto

(10) Patent No.: US 6,801,176 B1
(45) Date of Patent: Oct. 5, 2004

(54) SEMICONDUCTOR DEVICE AND LIQUID CRYSTAL DISPLAY COMPRISING THE SAME

(75) Inventor: Hajime Akimoto, Ome (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/787,241

(22) PCT Filed: Sep. 18, 1998

(86) PCT No.: PCT/JP98/04216

§ 371 (c)(1),
(2), (4) Date: Jun. 6, 2001

(87) PCT Pub. No.: WO00/17847

PCT Pub. Date: Mar. 30, 2000

(51) Int. Cl.[7] ..... G09G 3/36
(52) U.S. Cl. ..... 345/87; 345/92
(58) Field of Search ..... 345/87, 88, 90, 345/92, 94, 95, 98, 99, 100; 349/42, 43

(56) References Cited

U.S. PATENT DOCUMENTS 4,496,219 A * 1/1985 Altman ..... 345/51
4,803,462 A * 2/1989 Hester et al. ..... 341/172
5,623,519 A * 4/1997 Babcock et al. ..... 375/316
6,049,319 A * 4/2000 Sakamoto et al. ..... 345/94

OTHER PUBLICATIONS

IDRC 1994 Proceedings of Technical Paper, pp. 418–421.
IDRC ' 95 Proceedings of Technical Paper p. 418–421.

* cited by examiner

*Primary Examiner*—Richard Hjerpe
*Assistant Examiner*—Ronald Laneau
(74) *Attorney, Agent, or Firm*—Antonelli, Terry, Stout & Kraus, LLP

(57) ABSTRACT

A semiconductor device includes a selecting circuit to select its input between a binary logical input voltage and a DC input voltage, a capacitance having one end thereof connected to an output terminal of the selecting circuit, a binary inversion logical circuit having its input terminal connected to another end of the capacitance, and a switching circuit to short-circuiting between the input terminal and an output terminal of the binary inversion logical circuit in an ON state of the switching circuit. The DC input voltage is set to an intermediate value between a high voltage level and a low voltage level of the binary logical input voltage, and the switching circuit is turned into its OFF state at or before a time when the selecting circuit selects the binary logical input voltage as its input.

15 Claims, 8 Drawing Sheets

SEMICONDUCTOR DEVICE AND LIQUID CRYSTAL DISPLAY COMPRISING THE SAME

BACKGROUND OF THE INVENTION

1. Field of the Invention

The present invention relates to a semiconductor device and a liquid crystal display that comprises the semiconductor device.

2. Description of the Related Art

The structure of a conventional liquid crystal display having a thin film transistor (poly-Si TFT (Thin Film Transistor)) formed of polycrystalline silicon is shown in FIG. 14. Pixels each of which comprises a poly-Si 132 and a pixel capacitance 131 are disposed in matrix-fashion on the pixel region 124, and the gate of each poly-Si TFT 132 is connected to a gate line 134 and the drain is connected to a signal line 133. Only one pixel is shown in FIG. 14 for the purpose of simplification of the drawing herein. A gate line driving buffer 127 is disposed at the end of the gate line 134, and the gate line driving buffer 127 is scanned by means of a gate line shift register 126. The gate line shift register 126 is driven by means of a gate line clock generator 125. A signal line selection switch 123 is disposed at the end of the signal line 133, and the signal line selection switch 123 is scanned by means of a shift register 122. The signal line shift register 122 is driven by means of the signal line clock generator 121. An analog signal input line is connected to the signal line selection switch 123.

Next, the operation of FIG. 14 will be described. The gate line shift register 126 selects the gate line successively through the gate line driving buffer 127 according to the clock pulse supplied from the gate line clock generator 125. The poly-Si TFT 132 of the pixel on the selected row is set to be ON. The signal line shift register 122 scans the signal line selection switch 123 successively according to the clock pulse generated by means of the signal line clock generator 121 in the time period. The signal line selection switch 123 connects the corresponding signal line 133 to the analog signal input line 135 during scanning. Therefore, the image signal supplied to the analog signal input line 135 is written successively in the pixel capacitance 131 through the signal line 133 and the poly-Si TFT 132.

Next, the basic circuit structure of the signal line clock generator 121 is shown in FIG. 15. Each of inverters 101 to 105 and 111 to 115 comprises a CMOS circuit of poly-Si TFT. The input clock Vin is converted to the output clock $\phi$ and $\phi$(inv.) having the phase that is inverted just by angle of $\pi$ through the inverter circuits. Herein, $\phi$(inv.) means the waveform of inverted phase ideally. Because the output clock $\phi$ and $\phi$(inv.) are involved in driving of one unit signal selection switch 123 in the form of pair through the signal line sift register 122, it is important that the phase difference between both phases is equalized to $\pi$ in order to improve the image quality. For example, IDRC (International Display Research Conference) 1994 Proceedings of Technical Paper, pp. 418 to 421 describes the prior art in detail.

The above-mentioned prior art describes the method for eliminating the error of the phase difference between the output clock $\phi$ and $\phi$(inv.) of the same pair, but does not describe a method for eliminating the phase deviation between the output clock $\phi$1 and $\phi$2 of the different adjacent pair. If the phase deviates between both output clocks each other, when the signal selection switch 123 is turned on or turned off, the scan signal of the signal line selection switch 123 jumps from a signal selection switch 123 into the adjacent signal selection switch 123, and the jump cause a problem. In detail, when the second signal selection switch 123 that is located adjacent to the first signal selection switch 123 is turned on before the first signal selection switch 123 that is ON currently is turned off, the scan signal of the second signal selection switch 123 jumps into the first signal selection switch 123. Thereafter, when the first signal selection switch 123 is turned off, the scan signal of the first signal selection switch 123 jumps into the second signal selection switch 123. As the result, the image quality becomes poor.

The above-mentioned problem is described in detail with reference to FIG. 16 and FIG. 17. FIG. 16 shows the input/output characteristic of the inverters 103 and 113 shown in FIG. 15. $\phi$1 shows the characteristic curve of the inverter 113, and $\phi$2 shows the characteristic curve of the inverter 103. The logical threshold value of $\phi$1 is Vth1 and that of $\phi$2 is Vth2, and $\Delta$Vth denotes the deviation between both threshold values. The deviation is mainly due to the local dispersion of the threshold value of pMOS and nMOS that are components of the CMOS circuit, and the $\Delta$Vth is particularly remarkable for the CMOS circuit having poly-Si TFT. Generally, the threshold value dispersion of the single crystal Si-MOS transistor ranges approximately from 20 to 30 mV, on the other hand the threshold value dispersion of the poly-Si TFT ranges from several hundreds mV to several V. The reason why the threshold value dispersion of the poly-Si TFT is larger than that of the single crystal Si-MOS transistor in principle is that poly-Si TFT contains grain boundaries.

Next, the time t dependency of the input clock Vin on the inverter is shown in FIG. 17. The input clock Vin goes up from the low level voltage L to the high level voltage H step-wise with time. The deviation $\Delta$Vth between Vth1 and Vth2 corresponds to the difference $\Delta$t between t1 and t2 on the time axis, and $\Delta$t represents the logical inversion time deviation between the inverter 113 and the inverter 103. For example, it is assumed that $\Delta$Vth is 1 V and the inclination of the step of Vin is $10^7$ V/s, then $\Delta$t of $0.1\mu$ second is given. The time period of $0.1\mu$ second is sufficient for the scan signal to jump from a signal selection switch 123 into the adjacent signal selection switch 123.

The dispersion of the logical threshold value of the inverter as described herein above causes the low driving voltage of the logic circuit such as poly-Si TFT circuit and is resultantly problematic in high speed operation.

SUMMARY OF THE INVENTION

It is an object of the present invention to reduce the adverse effect of the logical threshold value dispersion of the inversion logical circuit such as inverter in a semiconductor device.

The above-mentioned object is achieved by applying a method, in which in addition to the conventionally used binary logical input voltage served as the input voltage an additional DC input voltage that is set to a value between the high voltage and the low voltage of the binary logical input voltage is provided, an additional changeover means for switching between these voltages and an additional capacitance having one end connected to the output terminal of the changeover means are provided, the other end of the capacitance is connected to the input terminal of the binary inversion logical circuit, an additional switching means for holding the voltage constant while the connection between the input terminal and the output terminal of the binary inversion logical circuit is being ON is provided, and the switching means and the changeover means are set so that the switching means is turned off simultaneously at the time when or before the changeover means is switched to the binary logical input voltage.

The operation of the logical circuit is described hereinunder. When the switching means is turned on, a DC input voltage, namely the logical threshold value, is applied on the series connection of the capacitance and the binary inversion logical circuit to thereby reset the series connection. Next, while the binary logical input voltage is being applied with the switching means OFF, when the value becomes a DC input voltage, namely the logical threshold value, the binary inversion logical circuit starts the operation such as ON/OFF operation or amplification. Because such operation is triggered by the logical threshold value of the series connection that is different from the logical threshold value of the binary inversion logical circuit itself, the above object is achieved.

For example, in the case that a plurality of series connections having a capacitance and binary inversion logical circuit are connected to the changeover means in parallel, all the series connections start the operation simultaneously with one logical threshold value.

The structure of the semiconductor device and liquid crystal display having such logical circuit is described in detail hereinunder.

(1) A semiconductor device is provided with a switching means for switching between a binary logical input voltage and a DC input voltage, a capacitance having one end connected to the output terminal of the switching means, a binary inversion logical circuit having the input terminal connected to the other end of the capacitance, and a switching means for holding a constant voltage between the input terminal and output terminal of the binary inversion logical circuit in the ON state. A value of the DC input voltage is set to an intermediate value between the high voltage and the low voltage of the binary logical input voltage, and the switching means is turned off at the time when or before the switching means switches the voltage to the binary logical input voltage.

(2) In the semiconductor device as described in (1), the constant voltage of the switching means is held by short-circuiting the binary inversion logical circuit between the input terminal and the output terminal.

(3) A semiconductor device is provided with a switching means for switching between a binary logical input voltage and a DC input voltage, a plurality of first type capacitances having one ends connected to the output terminal of the switching means, a plurality of first type binary inversion logical circuits having the input terminals connected to the other ends of the plurality of first type capacitances, and a plurality of first type switching means for holding a constant voltage between the input terminals and output terminals of the plurality of first type binary inversion logical circuits in the ON state. A value of the DC input voltage is set to an intermediate value between the high voltage and the low voltage of the binary logical input voltage, and the plurality of first type switching means are turned off at the time when or before the switching means switches the voltage to the binary logical input voltage.

(4) In the semiconductor device as described in (3), the capacitance of the plurality of first type capacitances is equal to each other.

(5) In the semiconductor device as described in (3), the constant voltage of the plurality of first type switching means is held by short-circuiting the plurality of first type binary inversion logical circuits between the input terminals and the output terminals.

(6) In the semiconductor device as described in (3), the semiconductor device is additionally provided with a plurality of series-connections of second type capacitances and second type binary inversion logical circuits connected to the respective output terminals of the plurality of first type binary inversion logical circuits.

(7) In the semiconductor device as described in (6), all the plurality of series-connections have a second type switching means for holding a voltage between the respective input terminals and output terminals of the second type binary inversion logical circuit that constitute the series-connections.

(8) A liquid crystal display is provided with a pixel region on which a plurality of pixels comprising poly-Si TFT and pixel capacitances arranged in the matrix fashion and a driving means for driving the pixel region. The driving means comprises a changeover means for switching between the binary logical input voltage and the DC input voltage, a capacitance having one end connected to the output terminal of the changeover means, a binary inversion logical circuit having the input terminal connected to the other end of the capacitance, and a switching means for holding a voltage between the input terminal and the output terminal of the binary inversion logical circuit at a constant voltage in the ON state. A value of the DC input voltage is set to an intermediate value between the high voltage and the low voltage of the binary logical input voltage, and an logical circuit that turns off the switching means at the time when or before the changeover means switches the voltage to the binary logical input voltage is included.

(9) In the liquid crystal display as described in (8), the constant voltage of the switching means is held by short-circuiting the binary inversion logical circuit between the input terminal and the output terminal.

(10) In the liquid crystal display as described in (8), the ON state of the switching means and the DC input voltage state are in the vertical interval time code.

(11) In the liquid crystal display as described in (8), the ON state of the switching means and the DC input voltage state are in the horizontal interval time code.

(12) In the liquid crystal display as described in (8), the logical circuit comprises a CMOS inverter circuit having a thin film transistor.

(13) A liquid crystal display is provided with a pixel region on which a plurality of pixels comprising poly-Si TFT and pixel capacitances arranged in the matrix fashion and a driving means for driving the pixel region. The driving means comprises a change over means for switching between the binary logical input voltage and the DC input voltage, a plurality of first type capacitances having one ends connected to the output terminal of the change over means, a plurality of first type binary inversion logical circuits having the input terminals connected to the respective other ends of the plurality of first type capacitances, and a plurality of first type switching means for holding a voltage between the respective input terminals and output terminals of the plurality of first type binary inversion logical circuits at a constant voltage in the ON state. A value of the DC input voltage is set to an intermediate value between the high voltage and the low voltage of the binary logical input voltage, and a logical circuit that turns off the plurality of first type switching means at the time when or before the change over means switches the voltage to the binary logical input voltage is included.

(14) In the liquid crystal display as described in (13), the capacitance value of the plurality of first type capacitances is equal to each other.

(15) In the liquid crystal display as described in (13), the constant voltage of the plurality of first type switching means is held by short-circuiting the plurality of first type binary inversion logical circuits between the respective input terminals and output terminals.

(16) In the liquid crystal display as described in (8), the logical circuit is applied to a signal line shift register served for driving a signal line selection switch used for connecting between the signal line connected to the drain of the poly-Si TFT and the analog signal input line corresponding to the signal line, and the logical input voltage is the start pulse of the signal line shift register.

(17) In the liquid crystal display as described in (8), the logical circuit is applied to a gate line driving buffer served for driving a gate line connected to the gate of the poly-Si TFT.

(18) In the liquid crystal display as described in (13), the logical circuit is applied to a signal line clock generator.

(19) In the liquid crystal display as described in (13), the ON state of the first type switching means and the DC input voltage state of the change over means are in the vertical interval time code.

(20) In the liquid crystal display as described in (13), the ON state of the first type switching means and the DC input voltage state of the change over means are in the horizontal interval time code.

(21) In the liquid crystal display as described in (13), the logical circuit comprises a CMOS inverter circuit having a thin film transistor.

The effect of the present invention is more remarkable as the driving frequency of the circuit increases more higher. The present invention is also applicable to a single crystal Si-MOS transistor circuit.

The above and further objects and novel features of the invention will more fully appear from following detailed description when the same is read in connection with the accompanying drawings. It is to be expressly understood, however, that the drawings are purpose of illustration only and not intended as a definition of the limits of the invention.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

DESCRIPTION OF THE PREFERRED EMBODIMENTS

First Embodiment

A poly-Si TFT liquid crystal display formed by applying the present invention to a signal line clock generator of a first embodiment of the present invention will be described with reference to FIG. 1 to FIG. 6.

Figure 2:
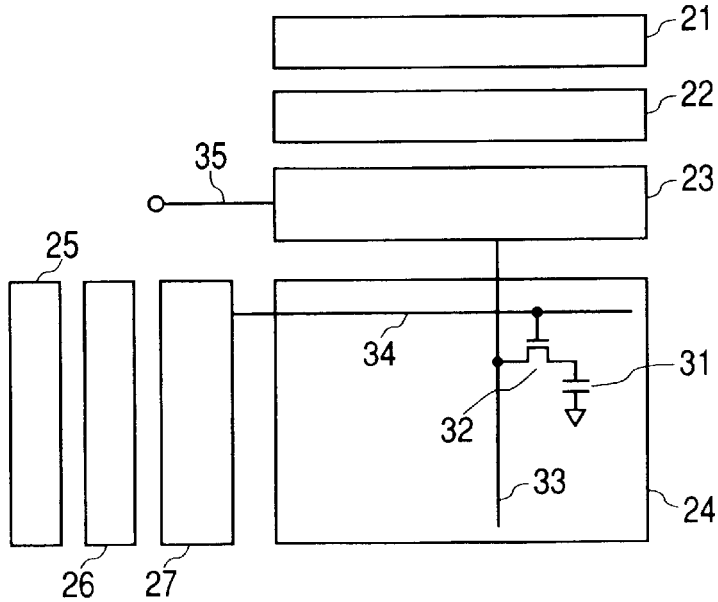
FIG. 2 is a structural diagram of a TFT liquid crystal display used in the first embodiment.

FIG. 2 is a structural diagram of the poly-Si TFT liquid crystal display. Pixels, each of which comprises a poly-Si TFT 32 and a pixel capacitance 31, are deployed on a pixel region 24 in the matrix fashion, and the gate of each poly-Si TFT 32 is connected to a gate line 34 and the drain is connected to a signal line 33. Only one pixel is shown in FIG. 2 for the purpose of simplification of the drawing. A gate line driving buffer 27 is provided at the terminal of the gate line 34, and the gate line shift register 26 scans the gate line driving buffer 27. The gate line shift register 26 is driven by means of the gate line clock generator 25. A signal line selection switch 23 is provided at the terminal of each signal line 33, and the signal line selection switch 23 is scanned by means of a signal line shift register 22. The signal line shift register 22 is driven by means of a signal line clock generator 21. The signal line selection switch 23 is connected to an analog signal input line 35.

The operation of the embodiment will be described hereinunder. The gate line shift register 26 successively selects the gate line 34 through the gate line driving buffer 27 according to the clock pulse supplied from the gate line clock generator 25. The poly-Si TFT 32 of a pixel on the selected row is set to be ON. The signal line shift register 22 successively scans the signal line selection switch 23 according to the clock pulse supplied from the signal line clock generator 21 during this time period. The signal line selection switch 23 successively connects the corresponding signal line 33 to the analog signal input line 35 during scanning. As the result, the image signal supplied to the analog signal input line 35 is successively written in the pixel capacitance through the signal line 33 and the poly-Si TFT 32.

Figure 1:
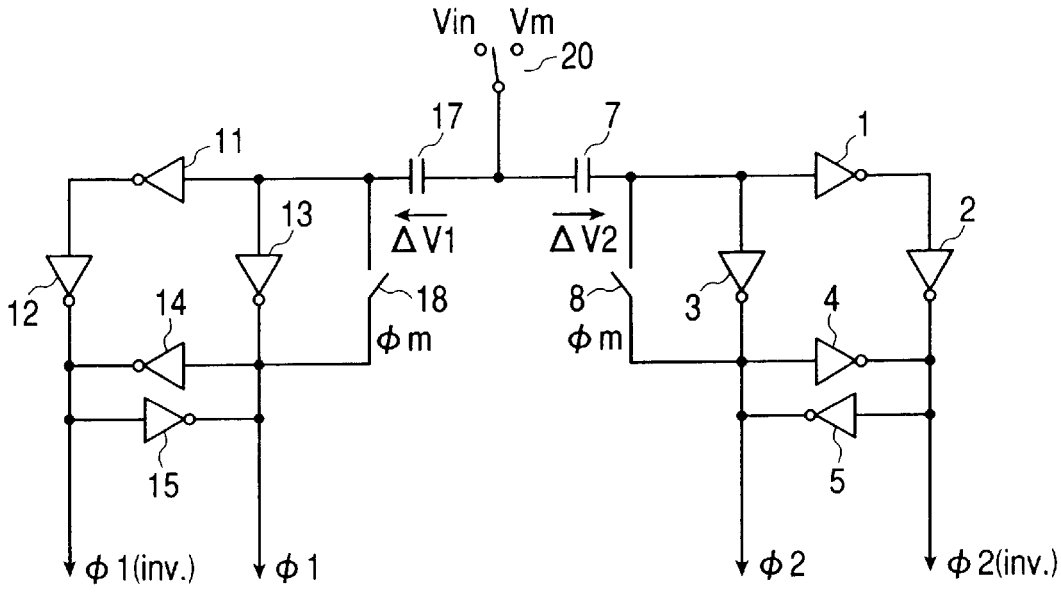
FIG. 1 is a basic circuit diagram of a signal line clock generator used in a first embodiment.

FIG. 1 is a basic circuit diagram of the signal line clock generator 21. Each of inverters 1 to 5 and 11 to 15 comprises a poly-Si TFT circuit. The phase of the input clock Vin is inverted so that the phase of the output clock ϕ and ϕ(inv.)

are inverted by an angle of π through these inverters. The above-mentioned structure and operation are the same as those of the conventional art, but in the embodiment, combination capacitances 7 and 17, reset switches 8 and 18 that are driven by means of the clock ϕm, and an input change over switch 20 are provided.

Figure 3:
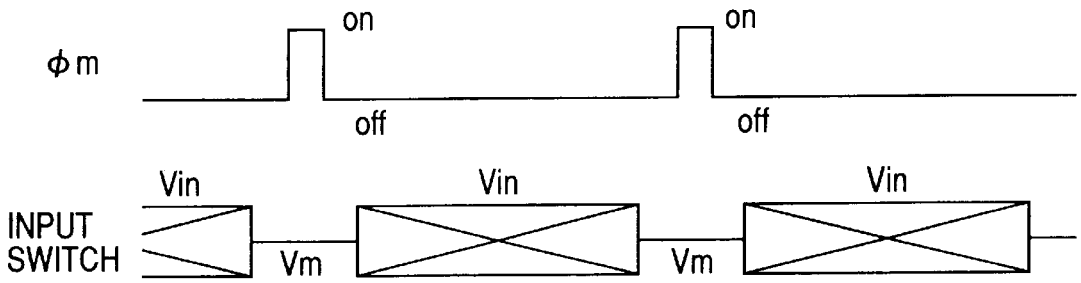
FIG. 3 is an operation explanatory diagram of an input change over switch for switching between the clock ϕm and the input clock Vin in the first embodiment.
Figure 4:
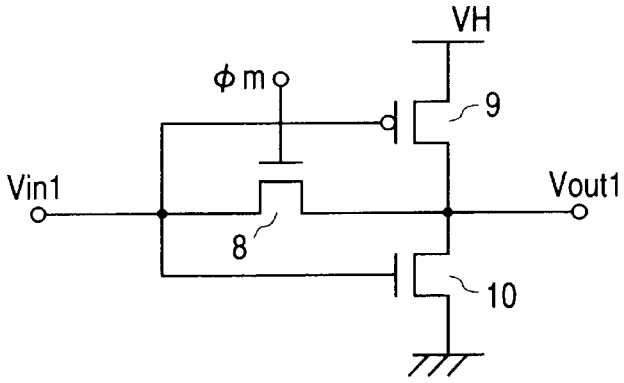
FIG. 4 is a structural diagram of a reset switch used in the first embodiment.
Figure 5:
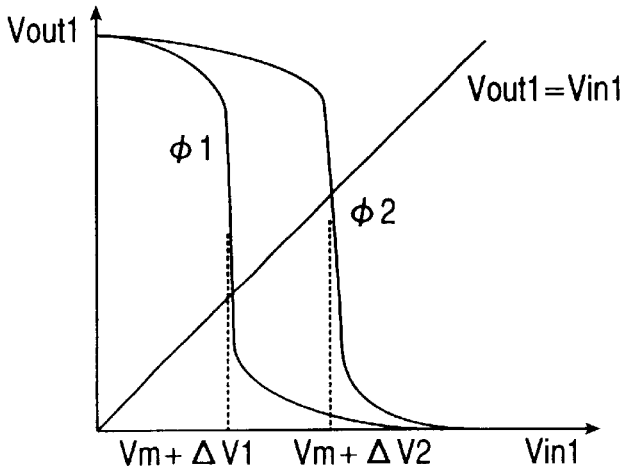
FIG. 5 is an input/output characteristic diagram of an inverter used in the first embodiment.

Next, the operation of the switches 8, 18, and 20 will be described with reference to FIG. 3 to FIG. 6. As shown in FIG. 3, the clock ϕm operates with a frame period of, for example, 1/60 second, and periodically turns on the reset switches 8 and 18 comprising nMOS in so-called vertical interval time code. The input of the input change over switch 20 is switched to a predetermined constant voltage Vm with the frame period so as to be equal to the ON time period of the clock ϕm or include the time period and so as to be connected to the clock input Vin during the residual time period. The function of the reset switch 8 is to make short-circuit between input/output of the inverter comprising a pMOS 9 and nMOS 10 as shown in FIG. 4. The characters Vin1 and Vout1 denote the input and output of the inverter 3 respectively, and the input/output characteristic ϕ2 is shown in FIG. 5. When the reset switch 8 is turned on at that time, the input of the inverter 3 is equalized to the output forcedly, and furthermore the voltage of the Vin1 terminal, namely the input of the inverter 3, is reset to (Vm+ΔV2) because the input change over switch 20 is switched to Vm. Herein, the ΔV2 is a voltage applied on the connection capacitance 7 and held with the connection capacitance 7. In other words, the input of the inverter 3 is automatically set to (Vm+ΔV2) when the input Vin is equal to Vm. Therefore, Vm is the logical threshold value of the inverter 3 to which the connection capacitance 7 is connected, and Vm is also the logical threshold value of the logical circuits including inverters following the inverter 3. Similarly, the input voltage of the inverter 13 having the input/output characteristic of ϕ1 is reset to (Vm+ΔV1). The character ΔV1 is a voltage applied on the connection capacitance 17, and held with the connection capacitance 17.

From the above description, it is obvious that the inverters 3 and 13 are inverted simultaneously by applying a logical threshold value Vm by use of the input change over switch 20 even though the input voltages of the respective inverters 3 and 13, namely the logical threshold values of the inverter 3 and 13 themselves, are (Vm+ΔV2) and (Vm+ΔV1) respectively, in other words, different each other.

The voltages ΔV2 and ΔV1 held with the connection capacitances 7 and 17 are obtained from the logical threshold value of the inverters themselves that is set as the input voltage of the inverter by equalizing the input/output of the inverter forcedly and from the logical threshold value Vm that is set arbitrarily, and based on this fact it is apparent that the values of the connection capacitances 7 and 17 are independent of each other. From the view point of element designing, the case of the same value is easier for designing.

A case in which the inverters 3 and 13 having the input/output characteristic for obtaining the logical threshold value of the inverter itself when the input/output voltages of the inverter is equalized are used is described in the embodiment, but as a matter of course a method for obtaining the logical threshold value of the inverter itself is different from the above-mentioned case in the case that the input/output characteristic is different from the above-mentioned case. For example, in the case that the threshold value of the input voltage is designed to be significantly deviated from the median of the input voltage amplitude, the logical threshold value of the inverter itself is set to a more correct value by means of a constant voltage source such as a battery connected to the reset switch 8 in series.

Figure 6:
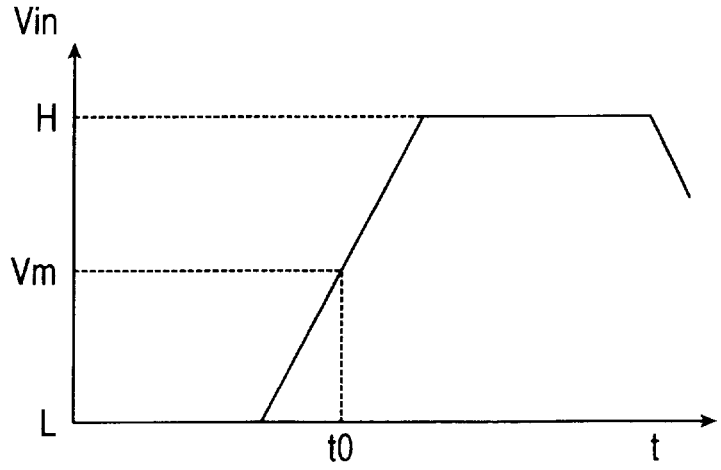
FIG. 6 is a diagram for showing the time dependency of the input clock in the first embodiment.

Next, the time t dependency of the input clock Vin is shown in FIG. 6. As shown in FIG. 6, Vin shifts from the low level voltage L to the high level voltage H step-wise with time. Though a profile is shown partially in the drawing, Vin shifts from the high level voltage H to the low level voltage L step-wise, and such shift is repeated. In the case that the logical threshold value Vm is set to, for example, a intermediate voltage between the low level voltage L and the high level voltage H, when Vin is equal to Vm at the time t0 shown in FIG. 6, the logical threshold voltages (Vm+ΔV2) and (Vm+ΔV1) of the respective inverters 3 and 13 themselves are supplied to the inverters 3 and 13 simultaneously. As the result, because ϕ1 and ϕ2 shown in FIG. 1 are inverted simultaneously and ON/OFF of the signal selection switch driven by ϕ1 and ϕ2 through the signal line shift register 122 is switched simultaneously, the scan signal is prevented from jumping between signal selection switches. Furthermore, it is possible to operate the signal line clock generator with a low voltage and resultantly to operate at high speed.

Second Embodiment

A poly-Si TFT liquid crystal display formed by applying the present invention to a signal line clock generator of a second embodiment of the present invention will be described with reference to FIG. 7 and FIG. 8.

Figure 7:
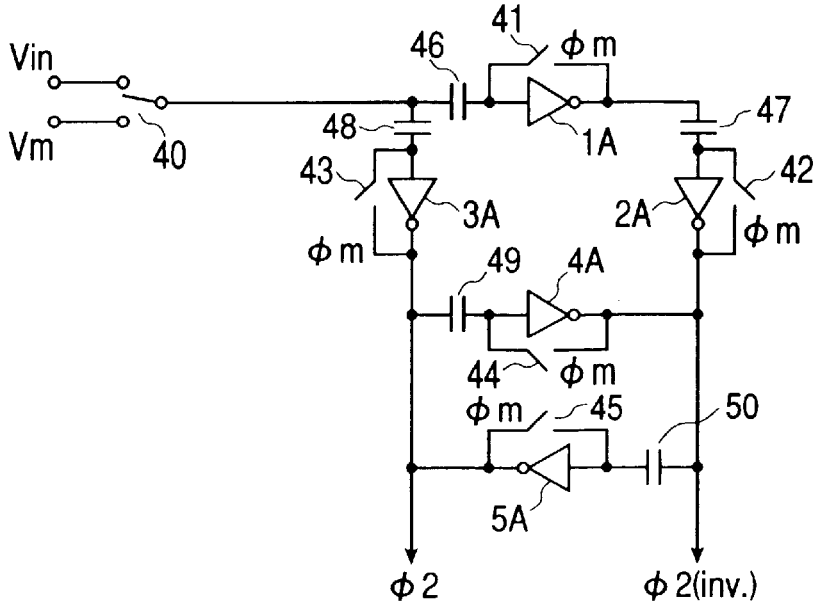
FIG. 7 is a basic circuit diagram of a signal line clock generator used in a second embodiment.
Figure 8:
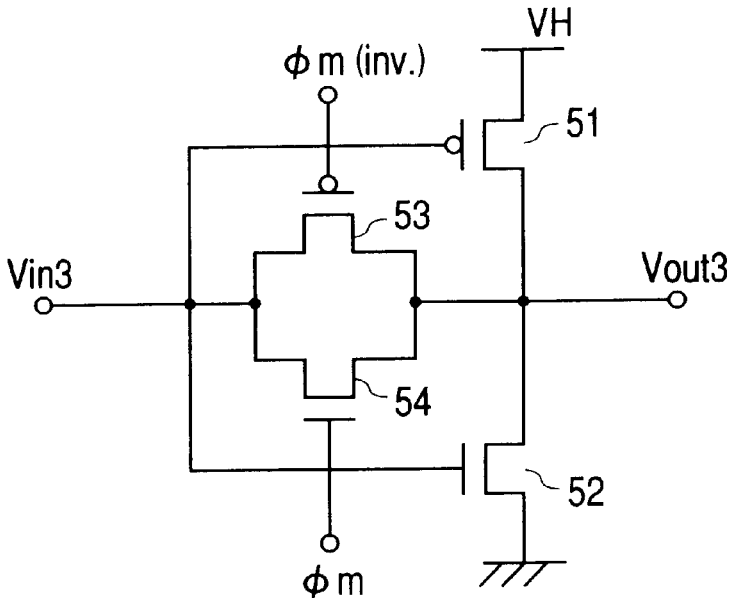
FIG. 8 is a structural diagram of a reset switch used in the second embodiment.

FIG. 7 shows a basic circuit diagram of the signal line clock generator 21 of the embodiment. Only the portion corresponding to the right half of FIG. 1 is shown for the purpose of simplification of the drawing. In the embodiment, the inputs of all the inverters 1A to 5A are DC-disconnected by the connection capacitances 46 to 50, and reset switches 41 to 45 that are driven by clock ϕm are provided between inputs and outputs respectively. Furthermore, an input change over switch 40 used for switching between clock input Vin and a predetermined constant voltage Vm is provided in the clock input Vin unit. The operational relation between the clock ϕm and the input change over switch 40 is the same as that of the first embodiment that has been already described with reference to FIG. 3, however, ϕm is driven not with frame period but with the horizontal scanning period in the embodiment. In other words, the input change over switch 40 is switched to Vm in the so-called horizontal interval time code. As the result, because the connection capacitances 46 to 50 are refreshed in the horizontal scanning period in the embodiment, it is possible to design the connection capacitances 46 to 50 relatively small with respect to the leakage current value in the input units of the inverters 1A to 5A. Furthermore, because the operating point of all the inverters is set to the logical threshold value of itself when the input voltage is equal to the logical threshold value in the signal line clock generator of the embodiment, it is possible to operate at higher speed with a lower voltage in comparison with the first embodiment.

CMOS switches are used as the reset switches 41 to 45 in the embodiment. FIG. 8 shows one inverter 1A and one reset switch 41, the inverter 1A comprises a pMOS TFT 51 and an nMOS TFT 52, and the reset switch 41 comprises a pMOS TFT 53 and an nMOS TFT 54. Because CMOS switch is used as the reset switches 41 to 45 as described herein above, it is possible to reduce the deviation of the operating point of the inverters 1A to 5A due to the feed through change during OFF of the reset switches 41 to 45 to a small value. Therefore, it is possible to operate at higher speed with a lower voltage in comparison with the first embodiment also from this view point.

Third Embodiment

A poly-Si TFT liquid crystal display formed by applying the present invention to a signal line shift register of a third embodiment of the present invention will be described with reference to FIG. 9 to FIG. 11.

Figure 9:
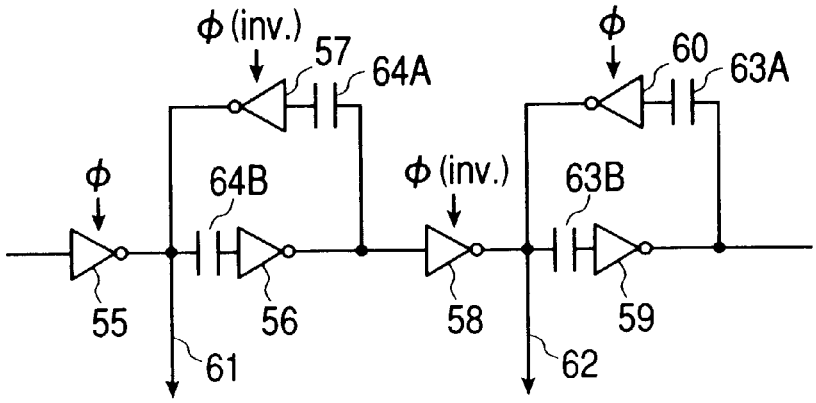
FIG. 9 is a basic circuit diagram of a signal line shift register used in a third embodiment.

FIG. 9 is a basic circuit diagram of the signal line shift register 22 of the embodiment. The signal line shift register 22 comprises inverters 55 to 60 and connection capacitances 63A, 63B, 64A, and 64B, and the inverters 55, 57, 58, and 60 are gate d by means of output clocks ϕ and ϕ(inv.) of the signal line clock generator 21. The above-mentioned structure allows the signal line shift register 22 shown in FIG. 9 to scan with ON voltage on the output lines 61 and 62 connected to the signal line selection switch 23 in the order synchronously with the output clocks ϕ and ϕ(inv.) of the signal line clock generator 21.

Figure 10:
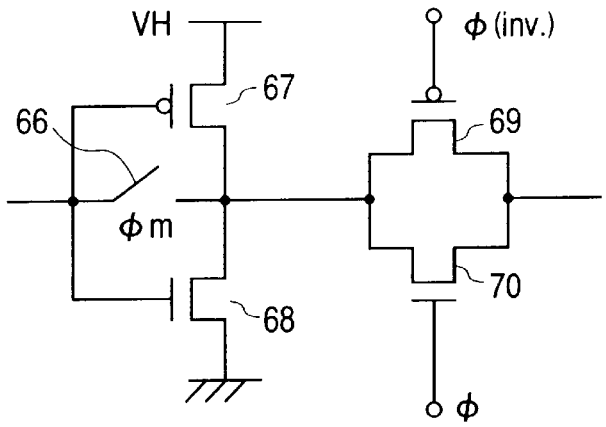
FIG. 10 is a circuit diagram of a gate inverter used in the third embodiment.

Next, the circuit of the gate inverter 55 is shown in detail in FIG. 10. An inverter circuit comprising a pMOS TFT 67 and an nMOS TFT 68 and a CMOS switch comprising a pMOS TFT 69 and an nMOS TFT 70 are cascade-connected in this order. An image signal is supplied from the left end of FIG. 10. A reset switch 66 that is controlled by means of clock ϕm is provided between the input and output of the CMOS inverter circuit, and the CMOS switch is driven by means of the output clocks ϕ and ϕ(inv.). The gate inverter 58 is the same as the gate inverter 55 excepting that the output clocks ϕ and ϕ(inv.) are inverted.

Figure 11:
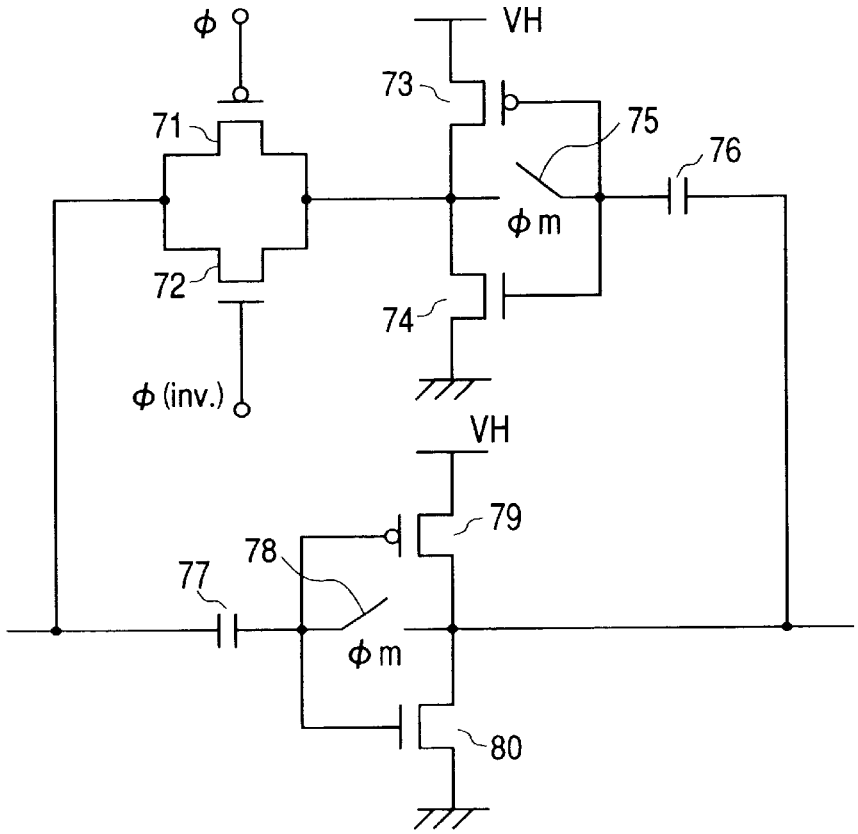
FIG. 11 is a circuit diagram of a flip-flop circuit used in the third embodiment.

Next, a detailed circuit of a flip-flop circuit comprising an inverter 56 and the gate inverter 57 is shown in FIG. 11. In the inverter 56, a connection capacitance 77 and a CMOS inverter circuit comprising a pMOS TFT 79 and an nMOS TFT 80 are cascade-connected. An image signal is supplied from the connection capacitance 77. In the gate inverter 57, a connection capacitance 76, a CMOS inverter circuit comprising a pMOS TFT 73 and an nMOS TFT 74, and a CMOS switch comprising a pMOS TFT 71 and an nMOS TFT 72 are cascade-connected. The inverter 56 and the gate inverter 57 are connected in parallel so that the output of the inverter 56 is supplied to the connection capacitance 76. Reset switches 78 and 75 that are controlled by means of clock ϕm are provided between input and output of CMOS inverter circuits of the inverter 56 and the gate inverter 57 respectively, and the CMOS switch is driven by means of the output clock ϕ and ϕ(inv.). The flip-flop circuit comprising an inverter 59 and a gate inverter 60 is the same as the flip-flop circuit excepting that the output clocks ϕ and ϕ(inv.) are inverted. Furthermore, a change over switch for switching between the start pulse and the logical threshold value of the signal line shift register 22 that is set to a predetermined constant voltage Vm is provided in the input unit of the signal line shift register 22 (through not shown in the drawing).

Next, the operation of the signal line shift register 22 shown in FIG. 9 will be described. The clock ϕm is driven with a frame period, and each reset switch becomes conductive during so-called vertical interval time code. At that time, the logical threshold value Vm of the signal line shift register 22 that is switched by means of a change over switch (not shown in the drawing) is applied on the input unit of the signal line shift register 22. The logical threshold value Vm is set to an intermediate voltage between, for example, the low level voltage and the high level voltage of the start pulse. All the CMOS switches driven by means of the clocks ϕ and ϕ(inv.) are OFF during the application of Vm.

In this state, the input voltage of the gate inverters 55, 57, 58, and 60 and the inverters 56 and 59 is reset to the logical threshold value of themselves. The potential difference between the logical threshold value of the gate inverter 55 itself and the logical threshold value Vm of the signal line shift register 22 is held at the connection capacitance 65 of the input side of the first gate inverter 55, and the potential difference between a connection capacitance and the precedent gate inverter or the inverter is held at each connection capacitance of gate inverters 57, 58, and 60 and inverters 56 and 59 other than the gate inverter 55.

By applying the above-mentioned structure and operation, it is possible to operate the signal line shift register 22 at high speed with a low voltage in the embodiment.

The signal line shift register is involved in the above-mentioned description, but as a matter of course the present invention is applied to the gate line shift register similarly. Furthermore, it is possible to drive the clock ϕm of the any one of or both shift registers with horizontal scanning period. In this case, the connection capacitance can be designed smaller as in the case of the second embodiment.

Furthermore, the binary inversion logical circuit comprising inverters has no amplification function in the first embodiment to the third embodiment. In other words, the voltage amplitude is equal at the input terminal and output terminal.

Fourth Embodiment

Figure 12:
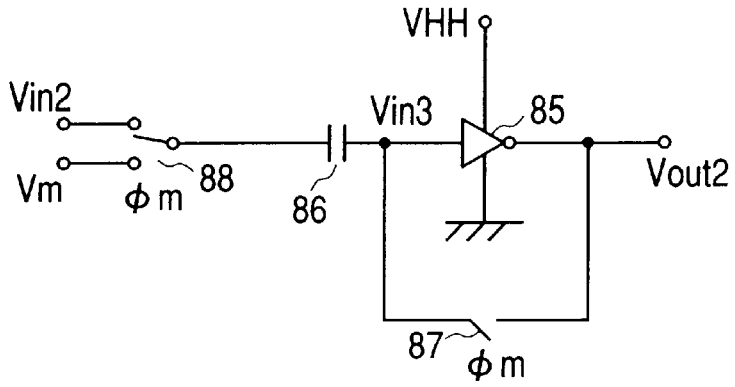
FIG. 12 is a basic circuit diagram of a gate line driving buffer used in a fourth embodiment.
Figure 13:
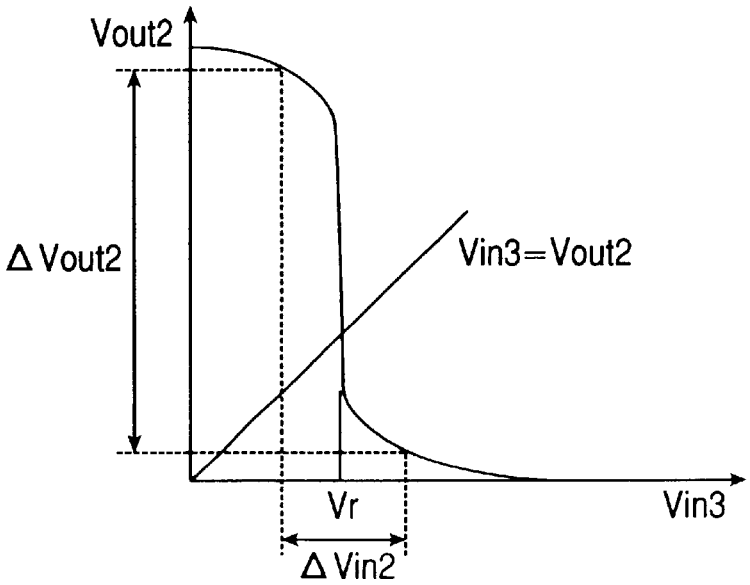
FIG. 13 is an operation characteristic diagram of a gate line driving buffer used in the fourth embodiment.
Figure 14:
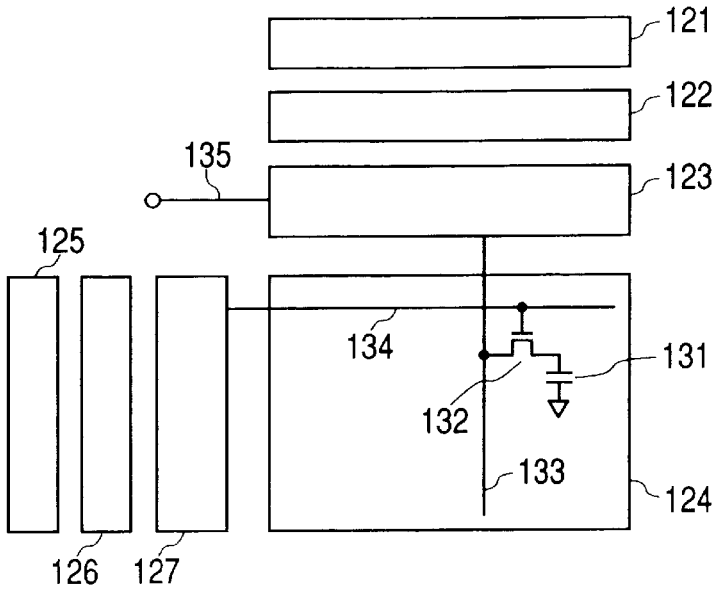
FIG. 14 is a structural diagram of a TFT liquid crystal display according to the conventional art.
Figure 15:
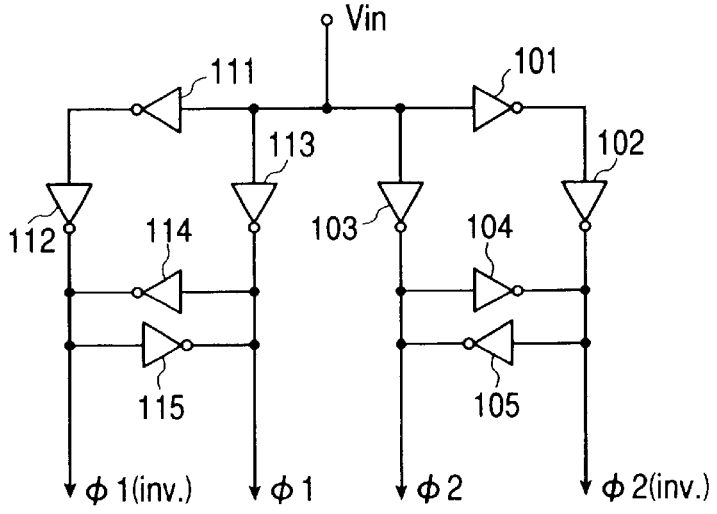
FIG. 15 is a basic circuit diagram of a signal line clock generator according to the conventional art.
Figure 16:
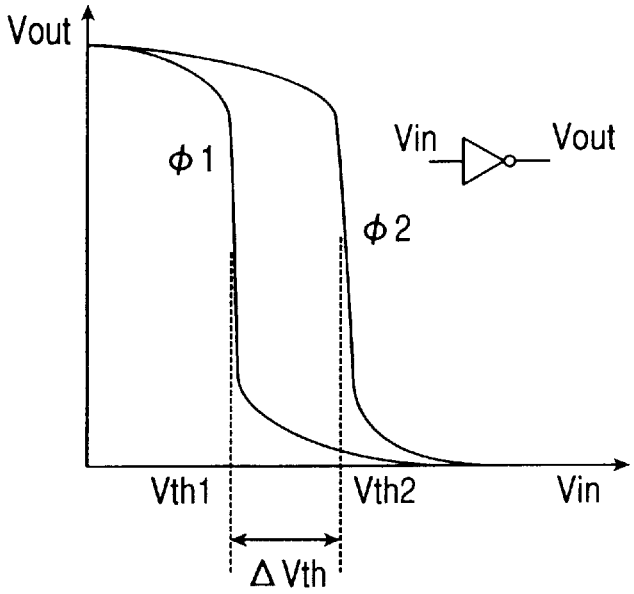
FIG. 16 is an input/output characteristic diagram of an inverter according to the conventional art.
Figure 17:
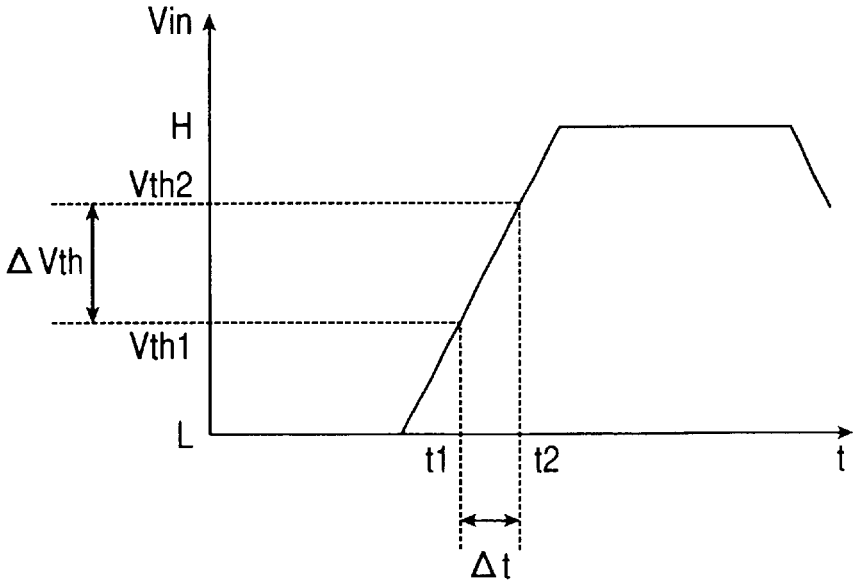
FIG. 17 is a diagram for showing the time dependency of the input clock according to the conventional art.

A poly-Si TFT liquid crystal display formed by applying the present invention to the gate line driving buffer of a fourth embodiment of the present invention will be described with reference to FIG. 12 and FIG. 13. In the case of the gate line driving buffer of the embodiment, the binary inversion logical circuit comprising an inverter 85 has the amplification function. FIG. 12 is a basic circuit diagram of the gate line buffer 27. The output Vin2 of the gate line shift register 26 is supplied to the inverter 85 through the connection capacitance 86. The gate line shift registers up to the gate line shift register 26 are driven with, for example, a low voltage amplitude of 5V for low power consumption, but because the voltage applied on a liquid crystal is, for example, ±5V, it is required for the gate line 34 to be driven with a large voltage amplitude of, for example, 15V. Therefore, it is required to apply a high voltage of, for example, 15V to the VHH terminal of the inverter 85. A reset switch 87 that is controlled by means of the clock ϕm driven with the frame period is provided, and a change over switch 88 for switching between the output Vin2 of the gate line shift register 26 and the logical threshold value Vm of the gate line driving buffer 27 that is set to a predetermined constant voltage is provided in the input unit of the gate line driving buffer 27.

Next, the operation of the gate line driving buffer 27 will be described with reference to FIG. 13. The operation timing of the change over switch 88 and the reset switch 87 that is controlled by means of the clock ϕm is the same as that of the first embodiment. When the change over switch 88 applies the logical threshold value Vm of the gate line driving buffer 27 to thereby turn on the reset switch 87, the input voltage and the output voltage of the inverter 85 are equalized to each other, and the input voltage is automatically set to the voltage Vr on the operational characteristic curve as shown in FIG. 13. Because the operational characteristic curve extends long to the output Vin2 side, the voltage Vr is not set to the exact logical threshold value of the inverter 85 itself but set to a value near the logical threshold value. The value is, for example, approximately 6V. In the case that the logical threshold value Vm of the gate line driving buffer 27 is set to an intermediate voltage of Vin2, for example, 2.5V, a voltage of (Vr−Vm)=3.5V is stored and held in the connection capacitance 86.

Next, the reset switch 87 becomes OFF during the vertical scanning period, and when the change over switch 88 is switched to Vin2, a signal of 0 to 5V is supplied from the input Vin2 to the inverter 85, and the input Vin3 of the inverter 85 becomes a value of 3.5 to 8.5V having the center at Vr (6V). As the result, because Vr is a value near the logical threshold value of the inverter 85 itself as described hereinabove, the output Vout2 of the inverter 85 swings fully approximately between 0 to 15V. In other words, through the voltage amplitude ΔVin2 of the input Vin2 is 5V, the voltage amplitude ΔVout2 of the output Vout2 is amplified surely to approximately 15V.

Furthermore, the operating point Vr is a value near the logical threshold value of the inverter 85 itself in the embodiment, but in the case that the operating point Vr is desiredly equalized to the logical threshold value, the equalization can be realized by employing a method in which the input/output voltage of the inverter is not equalized and a constant voltage source such as a battery is connected to the reset switch 87 in series.

As a matter of course, the embodiment operates very stably regardless of the dispersion of the logical threshold value of the inverter itself.

By applying the above-mentioned structure and operation, it is possible to operate the signal line shift register 22 at high speed with a low voltage in the embodiment.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalent.

What is claimed is:

1. A semiconductor device comprising:

a selecting circuit to select an input thereof between a binary logical input voltage and a DC input voltage, a capacitance having one end thereof connected to an output terminal of the selecting circuit, a binary inversion logical circuit having an input terminal thereof connected to another end of the capacitance, and a switching circuit to short-circuit between the input terminal and an output terminal of the binary inversion logical circuit in an ON state of the switching circuit, wherein a value of the DC input voltage is set to an intermediate value between a high voltage level and a low voltage level of the binary logical input voltage, and wherein the switching circuit is turned into an OFF state thereof at or before a time when the selecting circuit selects the binary logical input voltage as the input thereof.

2. A semiconductor device comprising:

a selecting circuit to select an input thereof between a binary logical input voltage and a DC input voltage and having an output terminal, and a plurality of circuit combinations, each of said plurality of circuit combinations comprising:

a first type capacitance having one end thereof connected to the output terminal of the selecting circuit, a first type binary inversion logical circuit having an input terminal thereof connected to another end of the first type capacitance, and a first type switching circuit to short-circuit between the input terminal and an output terminal of the first type binary inversion logical circuit in an ON state of the switching circuit, wherein a value of the DC input voltage is set to an intermediate value between a high voltage level and a low voltage level of the binary logical input voltage, and wherein the first type switching circuit in said each of the plurality of circuit combinations is turned into an OFF state thereof at or before a time when the selecting circuit selects the binary logical input voltage as the input thereof.

3. The semiconductor device according to claim 2, each of said plurality of circuit combinations further comprising a series combination of a second type capacitance and a second type binary inversion logical circuit, connected to the output terminal of the first type binary inversion logical circuit.

4. The semiconductor device according to claim 3, said series combination further comprising a second type switching circuit to short-circuit between an input terminal and an output terminal of the second type binary inversion logical circuit in an ON state of the second type switching circuit.

5. A liquid crystal display provided with a pixel region having arranged in a matrix fashion a plurality of pixels each comprising a poly-Si TFT and a pixel capacitance and a driving circuit to drive the pixel region, wherein the driving circuit includes a logical circuit, the logical circuit comprising:

a selecting circuit to select an input thereof between a binary logical input voltage and a DC input voltage;

a capacitance having one end thereof connected to an output terminal of the selecting circuit;

a binary inversion logical circuit having an input terminal thereof connected to another end of the capacitance; and a switching circuit to short-circuit between the input terminal and an output terminal of the binary inversion logical circuit in an ON state of the switching circuit, wherein the logical circuit turns the switching circuit into an OFF state thereof at or before a time when the selecting circuit selects the binary logical input voltage as the input thereof, and wherein a value of the DC input voltage is set to an intermediate value between a high voltage level and a low voltage level of the binary logical input voltage.

6. The liquid crystal display according to claim 5, wherein the ON state of the switching circuit and the selection of the DC input voltage are produced during vertical blanking periods.

7. The liquid crystal display according to claim 5, wherein the ON state of the switching circuit and the selection of the DC input voltage are produced during horizontal blanking periods.

8. The liquid crystal display according to claim 5, wherein the logical circuit comprises CMOS inverter circuits formed of thin film transistors.

9. A liquid crystal display comprising a pixel region having arranged in a matrix fashion a plurality of pixels each comprising a poly-Si TFT and a pixel capacitance and a driving circuit to drive the pixel region, wherein the driving circuit includes a logical circuit, the logical circuit comprising:

a selecting circuit to select an input thereof between a binary logical input voltage and a DC input voltage and having an output terminal, and a plurality of circuit combinations, each of said plurality of circuit combinations comprising:

a capacitance having one end thereof connected to the output terminal of the selecting circuit, a binary inversion logical circuit having an input terminal thereof connected to another end of the capacitance, and a switching circuit to short-circuit between the input terminal and an output terminal of the binary inversion logical circuit in an ON state of the switching circuit, wherein the logical circuit turns the switching circuit in said each of said plurality of circuit combinations into an OFF state thereof at or before a time when the selecting circuit selects the binary logical input voltage as the input thereof, and wherein a value of the DC input voltage is set to an intermediate value between a high voltage level and a low voltage level of the binary logical input voltage.

10. The liquid crystal display according to claim 9, wherein the logical circuit is employed in a signal line shift register to drive a signal line selection switch which connects an analog signal input line to a corresponding one of signal lines connected to drains of the poly-Si TFTs corresponding to an analog signal input, and the binary logical input voltage is a start pulse of the signal line shift register.

11. The liquid crystal display according to claim 9, wherein the logical circuit is employed in a gate line driving buffer circuit to drive gate lines connected to the gates of the poly-Si TFTs.

12. The liquid crystal display according to claim 9, wherein the logical circuit is employed in a signal line clock generator.

13. The liquid crystal display according to claim 9, wherein the ON state of the switching circuit and the selection of the DC input voltage are produced during vertical blanking periods.

14. The liquid crystal display according to claim 9, wherein the ON state of the switching circuit and the selection of the DC input voltage are produced during horizontal blanking periods.

15. The liquid crystal display according to claim 9, wherein the logical circuit comprises CMOS inverter circuits formed of thin film transistors.

* * * * *